United States Patent [19]

Garg et al.

[11] Patent Number: 4,695,369

[45] Date of Patent: Sep. 22, 1987

[54] CATALYTIC HYDROCONVERSION OF HEAVY OIL USING TWO METAL CATALYST

[75] Inventors: Diwakar Garg, Macungie; Edwin N. Givens, Bethlehem; Frank K. Schweighardt, Allentown, all of Pa.

[73] Assignee: Air Products and Chemicals, Inc., Allentown, Pa.

[21] Appl. No.: 895,570

[22] Filed: Aug. 11, 1986

[51] Int. Cl.[4] ..... C10G 45/04; C10G 45/06; C10G 47/02; C10G 47/26

[52] U.S. Cl. ..... 208/112; 208/216 R; 208/217; 208/251 H; 208/254 H; 208/246; 208/247; 208/295; 208/296

[58] Field of Search ..... 208/112, 108, 251 H, 208/254 H, 217, 216 R, 246, 247, 295, 296

[56] References Cited

U.S. PATENT DOCUMENTS

| | | | |
|---|---|---|---|
| 3,161,585 | 12/1964 | Gleim et al. | 208/264 |
| 3,364,134 | 1/1968 | Hamblin | 208/112 |
| 4,125,455 | 11/1978 | Herbstman | 208/108 |
| 4,134,825 | 1/1979 | Bearden et al. | 208/108 |
| 4,214,977 | 7/1980 | Ranganathan et al. | 208/108 |
| 4,285,804 | 8/1981 | Jacquin et al. | 208/48 |
| 4,352,729 | 11/1982 | Jacquin et al. | 208/209 |
| 4,411,767 | 10/1983 | Garg | 208/419 |
| 4,465,587 | 8/1984 | Garg et al. | 208/145 |
| 4,486,293 | 12/1984 | Garg | 208/10 |
| 4,552,650 | 11/1985 | Toulhoat et al. | 208/254 H |
| 4,564,441 | 1/1986 | Kukes et al. | 208/251 H |
| 4,578,180 | 3/1986 | Kukes et al. | 208/251 H |
| 4,600,504 | 7/1986 | Kukes et al. | 208/217 |
| 4,604,189 | 8/1986 | Derbyshire et al. | 208/251 H |
| 4,608,152 | 8/1986 | Howell et al. | 208/108 |
| 4,612,110 | 9/1986 | Kukes et al. | 208/112 |

FOREIGN PATENT DOCUMENTS

| | | | |
|---|---|---|---|
| 1117887 | 2/1982 | Canada | 196/148 |
| 1152925 | 8/1983 | Canada | 196/146 |

*Primary Examiner*—Andrew H. Metz
*Assistant Examiner*—Anthony McFarlane
*Attorney, Agent, or Firm*—Willard Jones, II; E. Eugene Innis; James C. Simmons

[57] ABSTRACT

A process for converting heavy petroleum feedstocks to distillate products with reduced metals and asphaltene content by reaction with hydrogen in the presence of at least two metal catalysts, one a known hydrogenation catalyst and the other either zinc, iron or copper.

11 Claims, 1 Drawing Figure

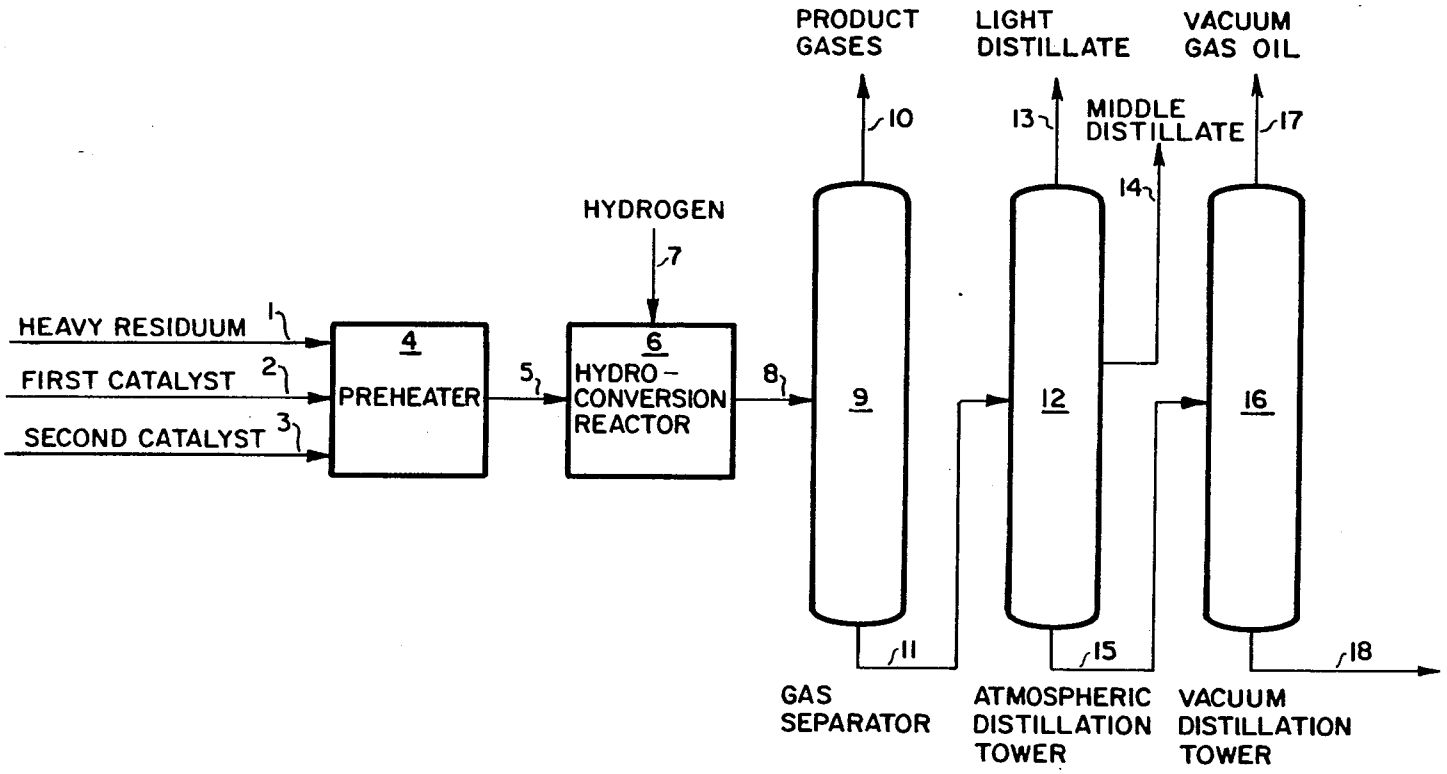
HEAVY RESIDUUM
1
FIRST CATALYST
2
SECOND CATALYST
3
4
PREHEATER
5
HYDROGEN
7
6
HYDRO-CONVERSION REACTOR
8
9
PRODUCT GASES
10
GAS SEPARATOR
11
12
LIGHT DISTILLATE
13
MIDDLE DISTILLATE
14
ATMOSPHERIC DISTILLATION TOWER
15
16
VACUUM GAS OIL
17
VACUUM DISTILLATION TOWER
18

CATALYTIC HYDROCONVERSION OF HEAVY OIL USING TWO METAL CATALYST

TECHNICAL FIELD

The present invention relates to the catalytic hydroconversion of heavy residual petroleum material.

BACKGROUND OF THE INVENTION

One of the most abundant energy sources in the world is heavy petroleum which must be converted catalytically to distillable products. For example, it has been estimated that there are over a trillion barrels of recoverable Orinoco Heavy Oil but there is no adequate process for upgrading this heavy oil to distillates. Another source of heavy oil is residuum from vacuum distillation of lighter crude petroleum. It is highly desirable to find more economical methods of converting heavy oil and petroleum residuum to useful fractions.

Most hydroconversion processes for the processing of heavy residual petroleum material with high conversion yields also induce large amounts of coke formation which formation not only reduces the overall conversion efficiency but also creates numerous operational problems leading to plant shutdown. Therefore, it is highly desirable to develop a process which will not only increase overall conversion but also decrease coke formation. For the heavy residuum conversion process to be commercially viable, the process must also entail low catalyst consumption rates, low cost, and continuous sustained operation.

A number of supported, unsupported and colloidally dispersed catalysts have been used for heavy residuum conversion. While these catalytic processes have improved overall yields, high conversion yields have been obtained by using either very high catalyst concentration or very severe reaction conditions. High catalyst concentration increases the catalyst cost making the process uneconomical, whereas the use of severe reaction conditions causes a significant increase in coke formation leading to plant shutdown.

The term hydroconversion is intended herein to designate a catalytic process conducted in the presence of hydrogen in which at least a portion of the heavy constituents and asphaltenes of the heavy hydrocarbon oil are converted at least in part to materials boiling below about 950° F. at atmospheric pressure and/or soluble in pentane, while simultaneously reducing the concentration of nitrogenous compounds, sulfur compounds and metallic contaminants. Heavy constituents are materials boiling above about 950° F. at atmospheric pressure. Asphaltenes are materials insoluble in pentane but soluble in benzene, pyridine, methylene chloride, etc.

Heavy hydrocarbon oils include heavy mineral oils; whole or topped petroleum crude oils, including heavy crude oils; asphaltenes; residual oils such as petroleum atmospheric distillation tower residua (boiling above 650° F.) and petroleum vacuum distillation toward residua (boiling above 950° F.); tars and bitumens. These heavy hydrocarbon oils generally contain a high content of metallic contaminants (e.g. nickel, iron, vanadium) usually present in the form of organometallic compounds (e.g. metalloporphyrins), a high content of sulfur compounds, a high content of nitrogenous compounds, and a high Conradson carbon residue. The metal content of such heavy oils may range up to 2,000 ppm by weight or more, the sulfur content may range from 0.5 to 8%, the gravity may range from −5° API to +35° API, and Conradson carbon residue (see ASTM test D-189-65) may range from 1 to about 50 weight percent. Preferably, the heavy hydrocarbon oil has at least 10 weight percent material boiling above 950° F. at atmospheric pressure, and more preferably having more than 30 weight percent.

U.S. Pat. No. 3,161,585 discloses a process for the hydrofining of heavy hydrocarbon charge stocks containing pentane-insoluble asphaltenes with a colloidally dispersed catalyst selected from the group consisting of a metal of Groups VB or VIB (vanadium, niobium, tantalum, chromium, molybdenum, and tungsten), an oxide of such metal , and a sulfide of such metal. The catalyst may be a colloidally dispersed combination of any two or more of the described metals, for example, colloidally dispersed molybdenum with colloidally dispersed vanadium, etc.

U.S. Pat. No. 4,134,825 discloses a process for catalytic hydroconversion of heavy hydrocarbons. The catalyst consists of oil soluble metals such as the ones selected from Groups IVB, VB, VIB, VIIB and VIII and mixtures thereof. The preferred metal is selected from the group consisting of molybdenum, vanadium or chromium.

Canadian Pat. No. 1,152,925 discloses a process for hydrocracking heavy oils in the presence of pyrite particles. It is also disclosed that the pyrite additive may be treated with metal salt solutions of catalytically active metals from Group VIB or VII.

Canadian Pat. No. 1,117,887 discloses a process for catalytic hydroconversions of heavy oils. The catalyst consists of a finely divided carbonaceous material carrying one or more metals of Group VB or VIII of the Periodic Table, for example, Co-Mo-coal.

U.S. Pat. No. 4,214,977 discloses a process for hydrocracking heavy oils using iron-coal catalyst. The presence of this catalyst is claimed to greatly reduce coke formation.

U.S. Pat. No. 4,352,729 discloses a process for hydrotreating heavy hydrocarbons in the presence of a molybdenum blue catalyst solution. It is also disclosed that the addition of at least one compound from the iron group to the molybdenum is advantageous, the preferred metals from the iron group being cobalt and nickel.

U.S. Pat. No. 4,285,804 discloses a process for hydrotreating heavy hydrocarbons in the presence of a dispersed catalyst. The catalyst is selected from the Groups VB, VIB, VIIB or VIII. The preferred metals are molybdenum, tungsten, cobalt or nickel.

U.S. Pat. No. 4,486,293 discloses a process for hydroliquefaction of coal in a hydrogen donor solvent in the presence of hydrogen and a co-catalyst combination of iron and a Group VI or Group VIII non-ferrous metal or compounds of the catalysts, but does not disclose conversion of heavy oil or residual petroleum.

SUMMARY OF THE INVENTION

An improved process for increasing the catalytic conversion of heavy petroleum feedstocks, containing a high concentration of asphaltenes and metal contaminants, to distillate products is achieved by passing the heavy oil with gaseous hydrogen in the presence of at least two metal catalysts to a reaction zone at elevated temperature and pressure. One of the metals is selected from a group of highly effective oil soluble hydrogenation catalysts which are relatively expensive, such as cobalt, nickel, molybdenum and tungsten, and preferably nickel or molybdenum. The second metal is chosen from a group of catalysts which are oil soluble or are fine particulate of less than or equal to 350 U.S. mesh, and which are relatively inexpensive and readily available such as zinc, iron, or copper, and preferably zinc or iron. The use of a combination of a small amount of a good hydrogenation catalyst and a greater amount of the relatively inexpensive second catalyst is unexpectedly found to increase the overall conversion and to decrease coke formation as compared to individual metal catalysts.

BRIEF DESCRIPTION OF THE DRAWING

The single FIGURE of the drawing is a schematic representation of the process according to the invention.

DETAILED DESCRIPTION OF THE INVENTION

The hydroconversion process according to the present invention is shown schematically in the drawing where the heavy oil or residuum 1 and at least two metal catalysts 2 and 3 are heated in a preheater 4. The heated mixture 5 and hydrogen via steam 7 enter the slurry phase hydroconversion (hydroprocessing) reactor 6. The effluent 8 exits from reactor 6 and is passed into a high pressure separator 9 from which the product gases 10 are removed and a condensed phase underflow 11 is passed to an atmospheric distillation tower 12. Light distillate 13 and middle distillate 14 are separated in atmospheric tower 12 from a bottoms fraction 15, which bottoms fraction 15 is passed to a vacuum distillation tower 16. Bottoms fraction 15 is distilled in vacuum tower 16 to recover a vacuum gas oil overhead 17 of lower sulfur, lower nitrogen, and lower metals content than the feed petroleum stream and a bottoms stream 18. This overhead stream 17 can be used directly or passed to downstream petroleum processing equipment (not shown) for further upgrading to fuels and lubricant components.

The term hydroconversion or catalytic conversion is intended to designate catalytic process conducted in the presence of hydrogen in which at least a portion of the heavy constituents and asphaltenes of the heavy hydrocarbon oil are converted at least in part to materials boiling below about 950° F.at atmospheric pressure and/or soluble in pentane, while simultaneously reducing the concentration of nitrogen compound, sulfur compound and metallic contaminants.

The invention is an improvement over a conventional hydroconversion process and utilizes at least two metal catalysts to process the pentane-insoluble portion of a heavy oil or residuum feedstock of non-distillable material (>950° F.), containing a high concentration of asphaltenes and metal contaminants, to produce high yields of distillate product (<950° F.) which is free of both metals and asphaltenes. The same catalysts can be utilized for the whole feedstock containing a comparatively lower concentration of metals and asphaltenes.

Conditions in reactor 6 are about 700° to 860° F., 400 to 4,000 psig hydrogen pressure, and a nominal residence time of 20 to 180 minutes.

The process is carried out in the presence of at lest two dispersed metal catalysts, the first at a concentration level of about 10 to 1,000 ppm based on feed and the second at about 0.05 to 1.2 wt % (500 to 12,000 ppm) based on feed. The concentration of the first catalyst is preferably at about 50 to 500 ppm based on feed. The concentrations are calculated as the elemental metal.

One metal is selected from a list of well-known, relatively expensive, highly effective oil soluble hydrogenation catalysts such as molybdenum, tungsten, cobalt, nickel and preferably nickel or molybdenum. The other catalyst is selected from inexpensive oil soluble or fine particulate, of less than or equal to 350 U.S. mesh, catalysts such as zinc, iron or copper, and preferably zinc or iron.

The advantages of the present invention are as follows. A high contact area of catalyst and hydrocarbon is achieved. The use of an inexpensive metal such as iron or zinc along with a small amount of an expensive highly effective hydrogenation catalyst allows unexpectedly higher conversion yields than without the inexpensive metal. Heavy residuum containing either low or high concentrations of metals and asphaltenes is processed without catalyst poisoning.

Two sets of experiments were performed to demonstrate the invention. The first set, Set A, provides data obtained by processing the high-metals and high-asphaltenes containing pentane-insoluble petroleum fraction in a microautoclave reactor using individual metal catalysts and their combinations. The secnd set, Set B, provides data obtained by processing the comparatively low-metals and low-asphaltenes containing whole feed (Kuwait vacuum distillation bottoms) in a continuous stirred tank reactor using individual metal catalysts and their combinations.

The following Examples 1 to 12 describe the results of Set A. Table 1 illustrates the crude solvent extraction of vacuum distillation bottoms of the Kuwait crude shown in the first column. The yields of pentane soluble and pentane insolube materials are 78% and 22%, respectively. The analysis of metals in the whole feed, and pentane soluble and pentane insoluble fractions are also summarized in Table 1. Notice that a majority of the metals were concentrated in the pentane insoluble fraction. This metals-rich pentane insoluble fraction (asphaltene-rich material) was used as a feedstock for subsequent hydroconversion experiments of Set A, the results of which are shown in Table 2 with catalyst concentrations also shown in Table 3.

TABLE 1

Analysis of Kuwait Vacuum Bottoms

| | | Crude Pentane Extraction | |
|---|---|---|---|
| | Whole Feed | Pentane Solubles | Pentane Insolubles |
| Wt. % of Feed | — | 78 | 22 |
| Elemental | | | |
| Carbon | 83.62 | | |
| Hydrogen | 10.19 | | |
| Nitrogen | 0.45 | | |
| Oxygen | 0.37 | | |
| Sulfur | 5.34 | | |
| Metals, ppm | | | |
| Ni | 34 | <12 | 111 |
| V | 117 | 39 | 339 |
| Fe | <21 | [a] | [a] |
| Conradson Carbon, wt. % | 21.1 | | |

[a]Not measured

TABLE 2

| Hydroconversion of Heavy Oil | | | | | |
|---|---|---|---|---|---|
| | Example 1 | Example 2 | Example 3 | Example 4 | |
| Catalyst | None | 250 ppm Mo | 0.5% Zn | 250 ppm Mo + 0.5% Zn | |
| Product Distribution[a]: | | | | | |
| | | | | I | II |
| Gases & Oils | 26.8 | 30.3 | 33.0 | 51.3 | 52.1 |
| Unconverted Material | 33.7 | 58.6 | 61.6 | 44.0 | 45.0 |
| Coke[b] | 39.5 | 11.1 | 5.4 | 4.7 | 2.9 |
| Conversion | 26.8 | 30.3 | 33.0 | 51.3 | 52.1 |
| | Example 5 | Example 6 | Example 7 | Example 8 | |
| Catalyst | 250 ppm Mo + 0.626% Zn | 250 ppm Mo + 0.156% Zn | 250 ppm Ni | 250 ppm Ni + 0.5% Zn | |
| Product Distribution[a]: | | | | | |
| Gases & Oils | 49.4 | 44.5 | 36.1 | 49.3 | |
| Unconverted Material | 47.8 | 52.3 | 53.2 | 47.6 | |
| Coke[b] | 2.8 | 3.2 | 10.7 | 3.1 | |
| Conversion | 49.4 | 44.5 | 36.1 | 49.3 | |
| | Example 9 | Example 10 | Example 11 | Example 12 | |
| Catalyst | 250 ppm Ni + 0.5% Fe | 250 ppm Mo + 0.5% Fe | 250 ppm Mo + 1.0% Pyrite | 250 ppm Mo + 1.0% Reduced Pyrite | |
| Product Distribution[a] | | | | | |
| Gases & Oils | 40.6 | 43.5 | 42.1 | 50.3 | |
| Unconverted Material | 56.9 | 50.4 | 55.1 | 44.2 | |
| Coke[b] | 2.5 | 6.1 | 2.8 | 5.5 | |
| Conversion | 40.6 | 43.5 | 42.1 | 50.3 | |

[a]weight percent pentane insolubles
[b]methylene chloride insolubles

TABLE 3

| | Catalyst Metals Concentration | | | | | | | | | | | |
|---|---|---|---|---|---|---|---|---|---|---|---|---|
| Example Number | 1 | 2 | 3 | 4 | 5 | 6 | 7 | 8 | 9 | 10 | 11 | 12 |
| Catalyst Metals, wt % | None | | | | | | | | | | | |
| Molybdenum, ppm | | 250 * | | 250 * | 250 * | 250 * | | | | 250 * | 250 * | 250 * |
| Nickel, ppm | | | | | | * | 250 * | 250 * | 250 | | | |
| Zinc, percent | | | 0.5 * | 0.5 * | 0.626 *** | 0.156 *** | | 0.5 * | | | | |
| Iron, percent | | | | | | | | | 0.5 * | 0.5 * | | |
| Pyrite, wt % | | | | | | | | | | | 1.0 | |
| Reduced Pyrite, wt % | | | | | | | | | | | | 1.0 |

*Added as metal octoate
***Added as zinc sulfide

EXAMPLE 1

This example illustrates the hydroconversion of metals- and asphaltenes-rich feedstock (pentane insolubles) described in the third column of Table 1 without any added catalyst. The feed material consisting of 3 g of feedstock was reacted in a 50 ml tubing-bomb reactor at 425° C. for 60 minutes using a cold hydrogen pressure of 1,200 psig. Reaction product was analyzed by solvent separation technique to determine the conversion of pentane insolubles to pentane solubles and the data are shown in Table 2. The conversion of asphaltenes (i.e. pentane insolubles) to gases and oils (i.e. pentane solubles) was 26.8%. The formation of coke determined by methylene chloride insolubles was 39.5%

EXAMPLE 2

This example illustrates the hydroconversion of metals- and asphaltenes-rich feedstock with 250 ppm of molybdenum (Mo) added as molybdenum octoate. The feed material and reaction conditions used were the same as described in Example 1. The conversion of pentane insolubles to pentane solubles of 30.3% as shown in Table 2 was higher than the conversion of Example 1 which is 26.8%. The formation of coke at 11.1% was significantly lower than the Example 1 rate of 39.5%, indicating the benefit of using a molybdenum catalyst.

EXAMPLE 3

This example illustrates the hydroconversion of metals- and asphaltenes-rich feedstock with 0.5% zinc (5000 ppm Zn) added as zinc octoate. The feed material and reaction conditions used were the same as described in Example 1. The conversion rate of 33.0% was slightly higher than both Examples 1 and 2 as shown in Table 2. The formation of coke during the reaction of 5.4% was also lower than Examples 1 and 2.

EXAMPLE 4

This example illustrates the present invention. Three grams of the metals- and asphaltenes-rich feedstock described in the third column of Table 1 was mixed with both 250 ppm Mo and 0.5% Zn (5000 ppm) added as metals octoate and reacted at the same conditions described in Example 1. Two runs (I and II) were made at the same conditions. The conversion rates of 51.3% and 52.1% were significantly higher than Examples 1, 2 and 3 as shown in Table 2. Likewise, the formation of coke at 4.7% and 2.9% were lower than Examples 1, 2, and 3.

EXAMPLE 5

This example illustrates the present invention. The same metals- and asphaltenes-rich feedstock described above were mixed with 250 ppm Mo in the form of molybdenum octoate and 1.0% (10,000 ppm) zinc sulfide added as particulate matter having the composition described in Table 4. The reaction mixture was reacted at the same conditions described in Example 1. The conversion of 49.4% shown in Table 2 was again higher than Example 1, 2 and 3, but was slightly lower than Example 4. Coke formation at 2.8%, however, was lower than Examples 1, 2, 3 and 4.

TABLE 4

| Analysis of Sphalerite (Zinc Sulfide) | |
|---|---|
| | Weight % |
| Zn | 62.6 |
| S | 31.2 |
| Pb | 0.54 |
| Cu | 0.21 |
| Fe | 1.0 |
| CaO | 0.28 |
| MgO | 0.14 |
| $SiO_2$ | 2.45 |
| $Al_2O_3$ | 0.03 |
| X-Ray Diffraction Analysis | |
| Zns, FeS (Sphalerite type structure) | |

EXAMPLE 6

This example illustrates the present invention. The feed material for this example was the same as described in Example 5 except for the use of 0.25% zinc sulfide (2500 ppm) instead of 1% (10,000 ppm). The reaction conditions once again were the same as described in Example 1. Table 2 shows that the conversion of 44.5% was still higher than Examples 1, 2 and 3. The conversion, however, was lower than Example 5, indicating a decrease in conversion with corresponding decrease in the concentration of zinc sulfide. The coke formation of 3.2% was comparable to Example 5.

EXAMPLE 7

This example illustrates the hydroconversion of metals- and asphaltenes-rich feedstock with 250 ppm of nickel (Ni) added as nickel octoate. The feed material and reaction conditions used were the same as described in Example 1. The data summarized in Table 2 show higher conversion than Examples 1, 2 and 3. Coke formation was very similar to that noted in Example 2.

EXAMPLE 8

This example illustrates the present invention. Three grams of the metals- and asphaltenes-rich feedstock described in the third column of Table 1 was mixed with both 250 ppm Ni and 0.5% Zn (5000 ppm) added as metals octoate and reacted at the same conditions described in Example 1. Table 2 data show that the conversion of 49.3% was higher than in Examples 3 and 7. Coke formation of 3.1% was also lower than in Examples 3 and 7.

EXAMPLE 9

This example illustrates the present invention. The same metals- and asphaltenes-rich feedstock described above was mixed with both 250 ppm Ni and 0.5% iron (5000 ppm Fe) added as metals octoate and reacted at the same conditions described in Example 1. Table 2 shows that the conversion of 40.6% was higher than Example 7 and the coke formation of 2.5% was lower than Example 7.

EXAMPLE 10

This example illustrates the present invention. The same metals- and asphaltenes-rich feedstock was mixed with both 250 ppm Mo and 0.5% Fe (5000 ppm) added as metals octoate and reacted at the same conditions described in Example 1. Table 2 shows that the conversion of 43.5% was higher than Example 2 and the coke formation of 6.1% was lower than Example 2.

EXAMPLES 11 AND 12

This example illustrates the present invention. The same metals- and asphaltenes-rich feedstock described above was mixed with 250 ppm Mo added as molybdenum octoate and 1% (10,000 ppm) inexpensive particulate pyrite ($FeS_2$) or reduced pyrite (FeS) and reacted at the same conditions as described in Example 1. The analysis of the sample of pyrite obtained from the Robena mine at Angelica, Pa. is set out in Table 5. Reduced pyrite was generated by reducing Robena pyrite with hydrogen at approximately 400° C. The conversions in both cases of 42.1% and 50.3% were higher than Example 2 and the coke formations of 2.8% and 5.5% were lower than Example 2. The conversion of 50.3% with the addition of reduced pyrite was higher than the conversion of 42.1% with pyrite, but the coke formation of 2.8% with pyrite was lower than the coke formation of 5.5% with reduced pyrite.

TABLE 5

| Analysis of Robena Pyrite | |
|---|---|
| | Weight % |
| C | 4.5 |
| H | 0.3 |
| N | 0.6 |
| O | 6.0 |
| S | 41.3 |
| Fe | 42.3 |
| Sulfur Distribution | |
| Pyrite | 40.4 |
| Sulfate | 0.7 |
| Organic | 0.6 |
| Other Impurities — Al, Si, Na, Mn, V, Ti, Cr, Sr, Pb, Co, Mg, Cu, and Ni | |

The following Examples 13 to 15 describe the results of Set B obtained by processing of relatively low-metals and low-asphaltenes Kuwait vacuum bottoms feedstock in a continuous stirred tank reactor. The whole feedstock, described in the first column of Table 1, contains 34 ppm nickel and 117 ppm vanadium.

EXAMPLE 13

The feedstock was mixed with 125 ppm of fresh molybdenum catalyst based on feed in the form of the oil soluble molybdenum compound, molybdenum octoate, and passed through a one-liter continously stirred-tank reactor at 800° F. A residence time of 141 minutes (LHSV=0.43 $hr^{-1}$) and a hydrogen flowrate of 5,594 scf/bbl of feed, and a total pressure of 2,000 psig were used for the reaction. The product distribution summarized in Table 6 shows 57.6% conversion of vacuum bottom to distillate product. The cost of catalyst at this level of catalyst consumption is $0.70/bbl based on molybdenum cost of $18/lb.

TABLE 6

| Hydrotreating of Kuwait Vacuum Bottoms | | | |
|---|---|---|---|
| | Example 13 | Example 14 | Example 15 |
| Catalyst | 125 ppm Mo | 250 ppm Mo | 125 ppm Mo + 0.25% ZnS |
| Reaction Temp., °F. | 800 | 800 | 800 |
| Nominal Residence Time, Min. | 141 | 120 | 147 |
| Pressure, psig | 2,000 | 2,000 | 2,000 |
| $H_2$ Flow Rate, scf/bbl | 5,594 | 5,380 | 5,980 |
| Product Distribution, wt. %[a] | | | |
| $H_2S + H_2O + NH_3$ | 2.0 | 2.5 | 2.3 |
| $C_1$-$C_3$ | 3.9 | 4.0 | 3.9 |
| $C_4$-950° F. | 52.9 | 55.8 | 56.1 |
| >950° F. | 42.4 | 39.2 | 39.0 |
| Conversion, % | 57.6 | 60.8 | 61.0 |
| $H_2$ Consumption | | | |
| wt. % | 1.16 | 1.53 | 1.34 |
| scf/bbl | 729 | 962 | 840 |
| Desulfurization, % | 32 | 37 | 35 |
| Denitrogenation, % | 3 | 14 | 5 |
| Deoxygenation, % | 21 | 40 | 27 |
| Catalyst Cost, $/bbl | 0.70 | 1.40 | 1.00 |

[a]Based upon wt % >950° F. material in the feed

EXAMPLE 14

This example also illustrates the hydroprocessing of low-metals and low-asphaltenes containing Kuwait vacuum bottoms in the reactor described in Example 13. The feedstock in this example was mixed with 250 ppm of molybdenum catalyst rather than 125 ppm used in Example 13. Reaction conditions used in this example were similar to those used in Example 13. Product distribution summarized in Table 6 shows that doubling the catalyst concentration from 125 to 250 ppm increased the conversion from 57.6 to 60.8%. Hydrogen consumption increased from 1.16 to 1.53%. The cost of catalyst doubled from $0.70 to $1.40.

EXAMPLE 15

This example illustrates the present invention. The feedstock described in Example 13 was mixed with 125 ppm of molybdenum and 0.25% (2500 ppm) of sphalerite (described in Table 4) and reacted at the same reaction conditions as described in Example 13. Product distribution summarized in Table 6 showed higher conversion than Example 13, but conversion was very similar to that noted in Example 14. Hydrogen consumption was higher than Example 13, but was lower than Example 14. The use of sphalerite in conjunction with molybdenum increased the catalyst cost from $0.70/bbl to $1.00/bbl, but the increase in catalyst cost is much lower than observed with the addition of 250 ppm of molybdenum in Example 14. The invention, therefore, shows significant improvements over both Examples 13 and 14 in terms of catalyst cost and conversion.

Several examples are presented above to show unexpected benefits of using a combination of catalysts in hydrotreating heavy residuum. Examples 13 to 15 show the benefits of using a combination of molybdenum and zinc in hydrotreating relatively low-metals and low-asphaltenes containing feedstock; the benefits are somewhat marginal for upgrading this feedstock. However, the benefits of increased yields with lower catalyst costs are dramatic when a high-metals and high-asphaltenes containing feedstock is upgraded in the presence of a combination of either molybdenum or nickel and zinc or iron as demonstrated in Examples 1 to 12. Therefore, combinations of catalysts according to the present invention can be used to greatly enhance the upgrading of both low-metals/low-asphaltenes and high-metals/-high-asphaltenes containing feedstocks.

While illustrating and describing specific embodiments of the process, it is readily apparent that many minor changes and modifications thereof could be made without departing from the spirit of the invention.

Having thus described our invention, what is desired to be protected by Letters Patent of the United States is set forth in the appended claims.

We claim:

1. In a process for hydrotreating a heavy hydrocarbon oil feedstock having a boiling point greater than 950° F. and containing asphaltenes and metal contaminants to produce distillate products having a boiling pont less than 950° F., said distillate products having reduced asphaltenes and metal contaminants at low coke formation rates, the improvement comprising contacting said feedstock with a gaseous hydrogen atmosphere at about 700° to 860° F. and 400 to 4,000 psig hydrogen pressure with a nominal reactor residence time of 20 to 180 minutes in the presence of a two dispersed metal compound catalyst system consisting essentially of a first and second dispersed metal compound catalyst component, wherein the first of said dispersed metal compound catalyst component being an oil soluble hydrogenation catalyst having a metal concentration of about 10 to 1,000 ppm, with said metal selected from the group consisting essentially of molybdenum, tungsten, cobalt, nickel, and mixtures thereof, and the second of said dispersed metal compound catalyst being selected from the group consisting of an oil soluble catalyst and a fine particulate catalyst of less than or equal to 350 U.S. mesh, and said second catalyst having a metal concentration of 0.05 to 1.2 wt.% (500 to 12,000 ppm), with said metal selected from the group consisting essentially of zinc, iron, copper, and mixtures thereof, said concentrations for either catalyst based upon the weight of said feedstock.

2. The process of claim 1 wherein the metal of the first catalyst is molybdenum.

3. The process of claim 2 wherein the metal compound of the first catalyst is molybdenum octoate.

4. The process of claim 1 wherein the metal of the first catalyst is nickel.

5. The process of claim 4 wherein the metal compound of the first catalyst is nickel octoate.

6. The process of claim 1 wherein the metal of the second catalyst is iron.

7. The process of claim 6 wherein the metal compound of the second catalyst is reduced pyrite.

8. The process of claim 6 wherein the metal compound of the second catalyst is pyrite.

9. The process of claim 1 wherein the metal of the second catalyst is zinc.

10. The process of claim 9 wherein the metal compound of the second catalyst is zinc sulfide.

11. The process of claim 1 wherein the concentration of said first catalyst is about 50 to 500 ppm based on said feedstock.

* * * * *